US008464422B2

(12) United States Patent
Holliday et al.

(10) Patent No.: US 8,464,422 B2
(45) Date of Patent: Jun. 18, 2013

(54) UNIVERSAL COAXIAL CABLE COMPRESSION TOOL

(75) Inventors: Randall A. Holliday, Broomfield, CO (US); Robert M. Parker, Aurora, CO (US)

(73) Assignee: Belden Inc., St. Louis, MO (US)

( * ) Notice: Subject to any disclaimer, the term of this patent is extended or adjusted under 35 U.S.C. 154(b) by 1216 days.

(21) Appl. No.: 11/716,488

(22) Filed: Mar. 9, 2007

(65) Prior Publication Data

US 2007/0251085 A1 Nov. 1, 2007

Related U.S. Application Data

(63) Continuation-in-part of application No. 10/927,884, filed on Aug. 27, 2004, now Pat. No. 7,188,507.

(51) Int. Cl.
*H01R 43/042* (2006.01)

(52) U.S. Cl.
USPC ..... 29/751

(58) Field of Classification Search
CPC ..... H01R 43/042
USPC ..... 29/751
See application file for complete search history.

(56) References Cited

U.S. PATENT DOCUMENTS

| | | | | |
|---|---|---|---|---|
| 2,369,180 | A | 2/1945 | Rosenthal | |
| 3,126,750 | A | 3/1964 | Willis | |
| 4,932,091 | A | 6/1990 | Krzyzanski | |
| 5,105,648 | A | 4/1992 | Steiner et al. | |
| 5,392,508 | A | 2/1995 | Holliday et al. | |
| 5,546,653 | A | 8/1996 | Tournier et al. | |
| 5,845,393 | A | 12/1998 | DePaiva | |
| 5,934,137 | A | 8/1999 | Tarpill | |
| 6,112,404 | A * | 9/2000 | Tarpill | 29/751 |
| 6,293,004 | B1 | 9/2001 | Holliday | |
| 6,594,888 | B2 | 7/2003 | Chang | |
| 6,708,396 | B2 * | 3/2004 | Holliday | 29/751 |
| 6,948,234 | B1 | 9/2005 | Steiner | |
| 2006/0042346 | A1 * | 3/2006 | Holliday et al. | 72/409.14 |

* cited by examiner

*Primary Examiner* — Livius R Cazan

(74) *Attorney, Agent, or Firm* — Schmeiser, Olsen & Watts, LLP

(57) ABSTRACT

A compression tool for connecting a cable fitting to the end of a cable includes a plunger having a chuck at one end together with an extension member releasably connected to the end of the chuck and aligned with enlarged recesses in spaced guideways, dies on the tool can be expanded to permit insertion of the connector fitting and cable into engagement with the end of the chuck or the extension member and contracted to apply a uniform crimping force to the fitting in response to axial force applied to the chuck, and the spaced guideways have angled guide slots to correlate the advancement of the dies with the effective length of the chuck to cause the cable fitting to be contracted into crimping engagement with the end of the cable; and a special cable fitting is provided for smaller cables to compensate for the difference in diameter between standard cables and the smaller cables.

20 Claims, 10 Drawing Sheets

UNIVERSAL COAXIAL CABLE COMPRESSION TOOL

CROSS REFERENCE TO RELATED APPLICATIONS

This application is a continuation-in-part of Ser. No. 10/927,884 filed 27 Aug. 2004 for COAXIAL CABLE FITTING AND CRIMPING TOOL by Randall A. Holliday and Robert M. Parker, now U.S. Letters Pat. No. 7,188,507 and incorporated by reference herein.

BACKGROUND AND FIELD

The following relates to compression devices, and more particularly relates to a novel and improved hand-held universal compression tool for crimping fittings of different lengths and diameters into sealed engagement with cables, such as, for example, coaxial cables employed in the cable TV industry.

Hand-held compression tools have been devised for crimping a connector onto the end of a coaxial cable and which are characterized in particular by being capable of reducing the diameter of the fitting into a generally circular configuration in response to an axially directed force to the fitting. Representative of these inventions are U.S. Pat. No. 5,392,508 for AXIAL DEFORMATION CRIMPING TOOL and U.S. Pat. No. 6,293,004 for LENGTHWISE COMPLIANT CRIMPING TOOL, both of said patents being owned by the assignee of this invention and incorporated by reference herein, the latter being characterized in particular by having a spring-loaded chuck on the end of a plunger which is axially advanced by a lever arm toward and away from an end stop into which a coaxial cable end and connector have been inserted. Movement of the plunger toward the end stop will force a crimping ring on the connector to radially contract the connector into crimping engagement with the cable end, and the spring-loaded chuck will compensate for differences in length of the fittings.

In U.S. Pat. No. 6,293,004, utilization of a preassembled crimping ring on the connector obviates utilization of a special die portion of the type disclosed in my U.S. Pat. No. 5,392,508. Nevertheless, there are numerous applications where utilization of a die portion mounted on the body of the tool is preferred over the utilization of a preassembled crimping ring. For example, the die portion eliminates the crimping ring and exerts more direct control over shaping of the fitting or sleeve into sealed engagement with the cable end. In the past, however, when the die portions have been mounted on the body of the tool they are difficult to open when the fitting becomes jammed; also the ability of the die halves to resist misalignment when subjected to crimping forces; and the ability of the tool to be self-adjusting for wear tolerances and other slight differences in size and length of each fitting or connector have presented problems in the field. Accordingly, there is an unmet need for a compression tool which will overcome the above and other problems associated with cable compression tools.

There is a further need for a universal compression tool capable of handling a wide range in sizes of coaxial cable connectors including the mini-coaxial cables, and which is adjustable to conform to variations in diameter and length of different cable fittings. In this relation, it is important to make the end of the plunger accessible to the user for the purpose of installing or removing an extension tip to make the necessary adjustment in length for the shorter cable fittings. Further, in the smaller size cables, it is important to compensate for the difference in diameter between standard cables and the smaller sized cables so that the tool embodiment herein described can crimp the fitting onto the cable without having to adjust the extent of radial and axial advancement of the die members.

SUMMARY

It is therefore an object to provide for a novel and improved crimping tool conformable for use in compressing different sizes and lengths of fittings onto the end of a cable in a reliable and efficient manner.

Another object is to provide for a novel and improved hand-held crimping tool for crimping fittings into sealed engagement with a coaxial cable without requiring a preassembled crimping ring but is capable of achieving a uniform seal notwithstanding differences in length of the fitting, or to compensate for the presence of wear or dirt and differences in manufacturing tolerances.

A further object is to provide for a novel and improved hand-held crimping tool for terminating cable ends without the use of a preassembled crimping ring which greatly facilitates both mounting and release of the cable end before and after the crimping operation and wherein the tool is lightweight but sturdy and requires a minimum number of parts.

A crimping tool has been devised for connecting the sleeve portion of a cable fitting to an end of a coaxial cable wherein the tool is provided with a cable-receiving die housing at one end, an elongated body having a plunger mounted for axial advancement through the body toward and away from the cable-receiving die housing and means for axially advancing the plunger toward and away from the die housing, the improvement comprising a plurality of die members mounted in the die housing for movement between a radially expanded position in which the cable fitting is slidable into contact with the plunger and a radially contracted position wherein relative advancement of the sleeve portion and the die members into engagement with one another causes the sleeve portion to be compressed into sealed, crimping engagement with the cable end.

In one embodiment, the die members are slidable radially and axially between the expanded and contracted positions in response to axial advancement of the plunger, and the die members are yieldingly urged toward the contracted position. The die members define circumferential portions of a common die cavity, and at least one of the die members is movable into and out of circumferential alignment with the other of the die members.

Another feature is that different sets of die members can be interchangeably mounted in the die housing according to the size and length of fitting to be crimped onto the cable end, and each set of die members defines a cavity having a first diameter corresponding to an outer diameter of the sleeve portion and a second diameter which corresponds to the outer diameter of the cable end. The housing itself is characterized by having inclined guideways on opposite sides of the housing to advance the die members between the expanded and contracted positions. The inclined guideways include end portions which increase the compressive force exerted by the die members on the sleeve portions in completing the crimping operation and are self-compensating for any manufacturing variance or wear of the die cavities and guide portions of the die members.

Still another feature resides in a coaxial cable fitting having a novel and improved crimping sleeve having a raised portion which will undergo reversal into an indented portion in sealed engagement with a cable end and which is adapted to be utilized with a crimping tool having a die member which will force the raised portion to undergo reversal into the indented position.

Alternate embodiments have been devised in which a compression tool is of the type hereinbefore described but includes an extension tip releasably connected to one end of the plunger to compensate for variations in length of the cable fitting to be crimped or terminated on the cable end, and the guideways on opposite sides of the tool are enlarged and provided with forward and rearward spaced, inclined guide portions to control slidable movement of the die members between the expanded and contracted positions so as to be conformable for use with a wide range of different diameter fittings. In this relation, by enlarging opposite sides of the tool, it is possible to form larger openings in the sides to gain access to the plunger for the purpose of insertion and removal of the extension tip. Further, in order to accommodate mini-coaxial cable fittings in the same compression tool as standard sized fittings, a plastic insert is interposed between the inner and outer concentric sleeve members of the fitting in order to compensate for the reduced thickness of the jacket end portion of the cable inserted between the concentric sleeve members as a preliminary to crimping.

As employed herein, "reference to "front" or "leading" means that end of the tool intended to crimp the fitting to the cable end and "rear" or "trailing" means the opposite or lever end.

The above and other objects, advantages and features will become more readily appreciated and understood from a consideration of the following detailed description of different forms of the present invention when taken together with the accompanying drawings in which:

DETAILED DESCRIPTION OF FIRST EMBODIMENT

Figures 1, 1A:
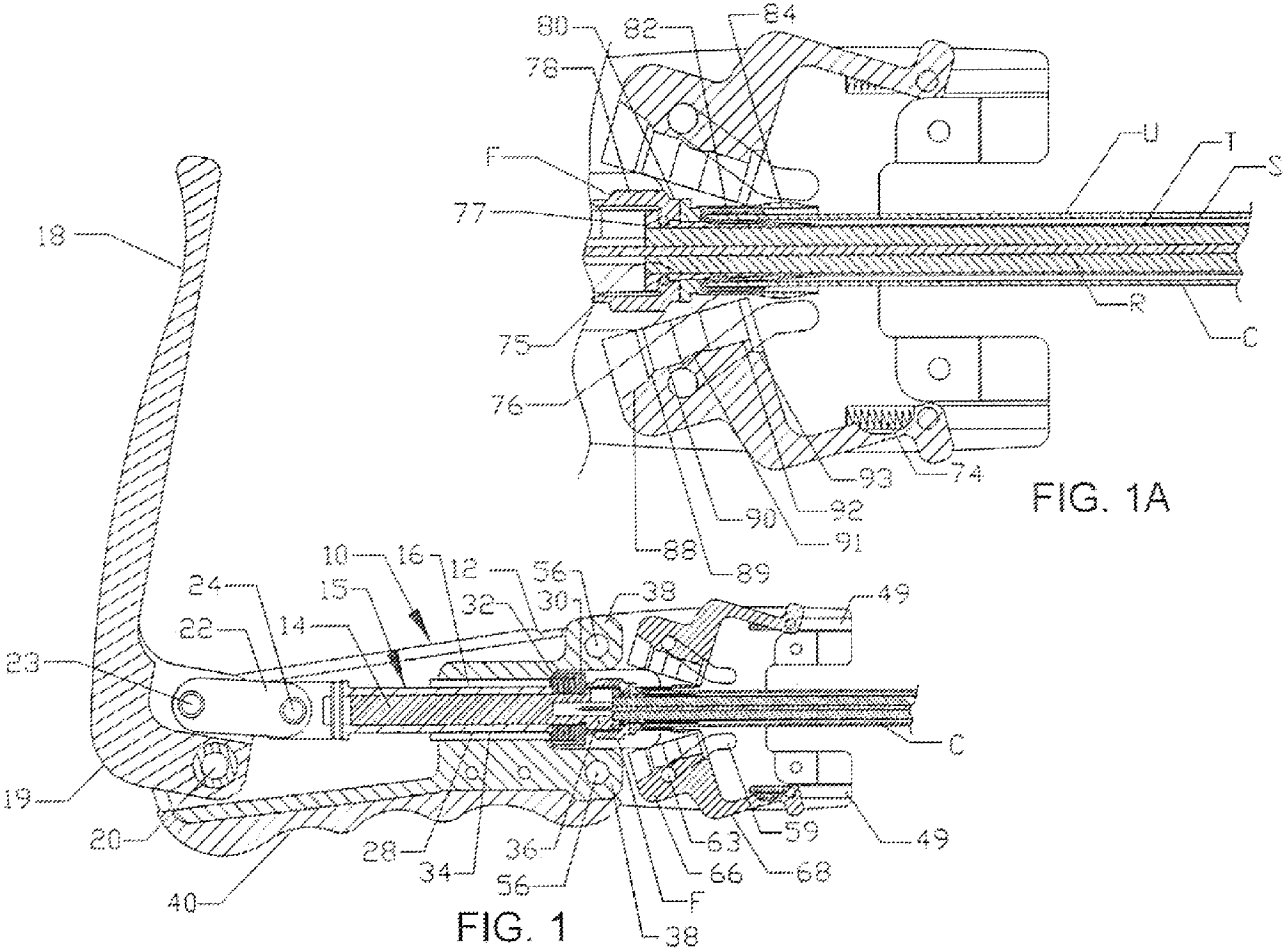
FIG. 1 is a longitudinal section view of a preferred form of crimping tool in accordance with the present invention.
FIG. 1A is an enlarged fragmentary view of the die portions in their spread position for insertion of a fitting and cable end into engagement with a chuck as shown in FIG. 1; the crimping operation.
Figure 2A:
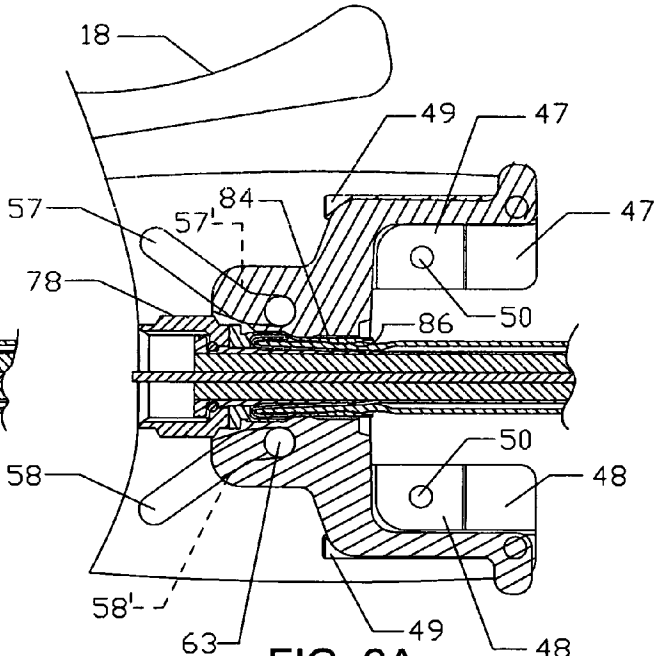
FIG. 2A is a detailed fragmentary section view of the die portions in their contracted position following the crimping operation.
Figure 2C:
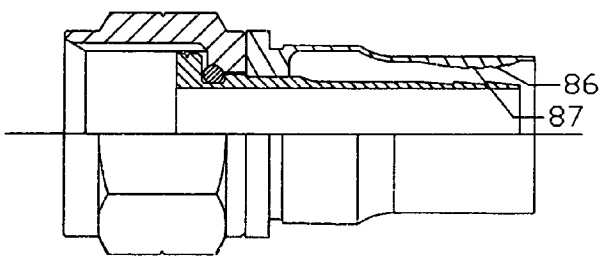
FIG. 2C is a sectional view of the connector illustrated in FIG. 2B after the crimping operation.
Figure 2:
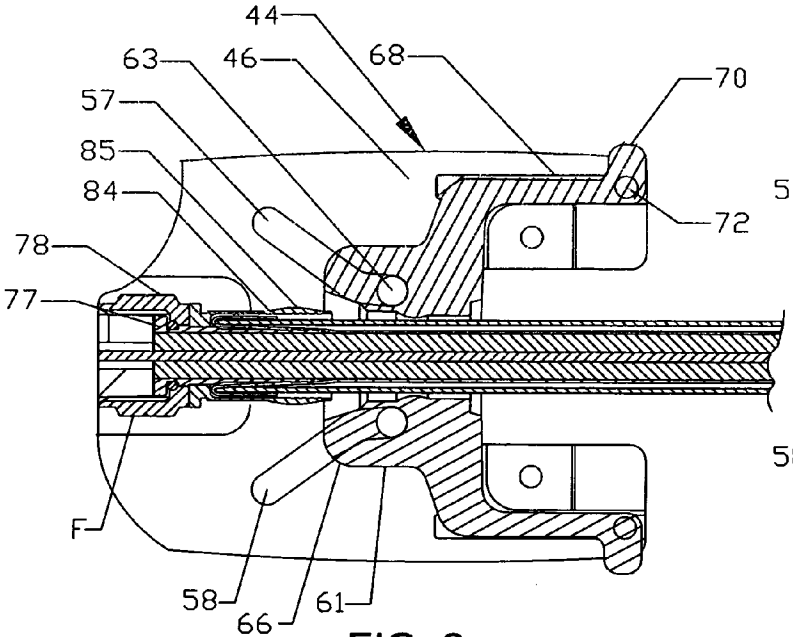
FIG. 2 is a detailed fragmentary section view of the die portions in their contracted position prior to the crimping operation.
Figure 3:
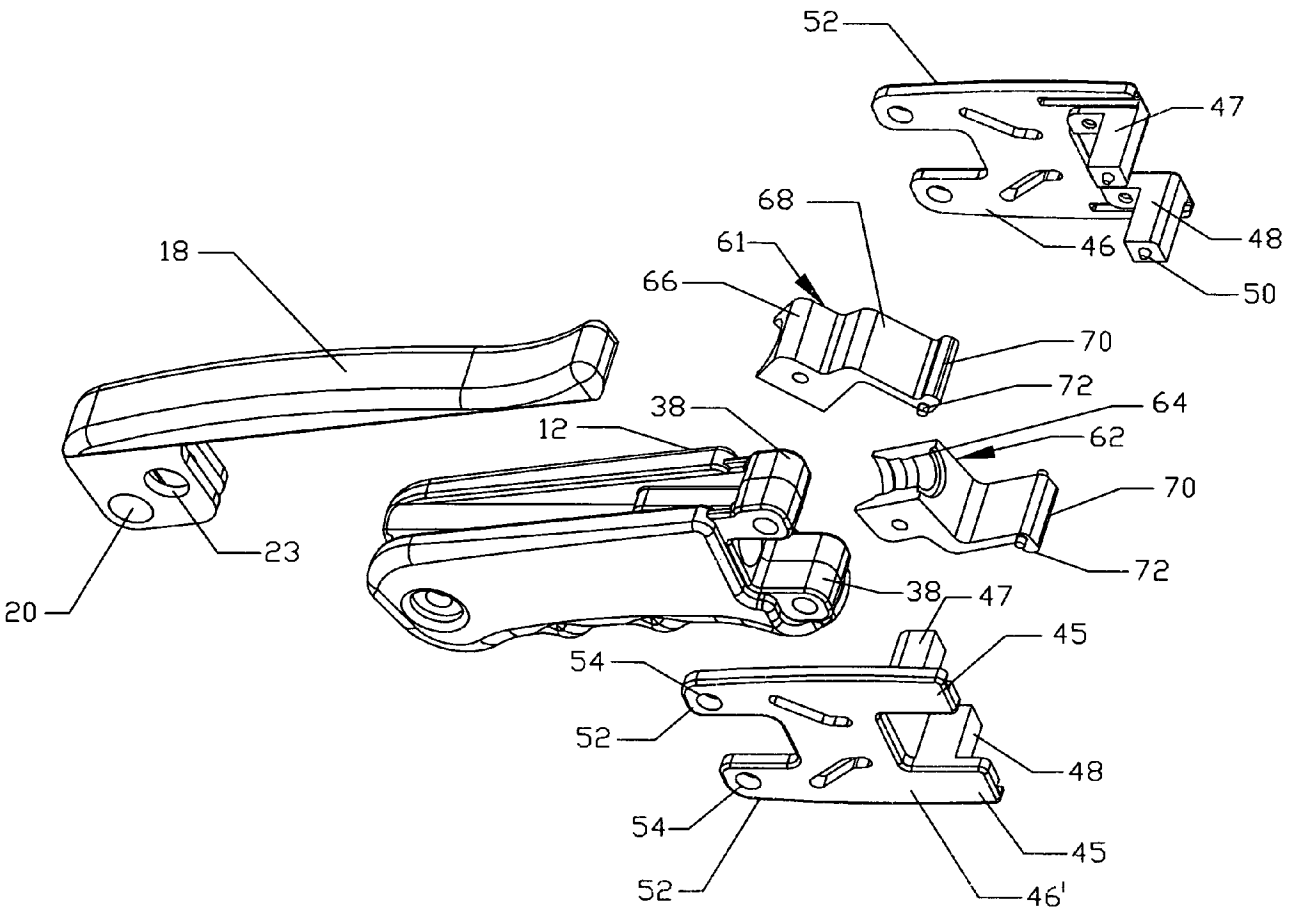
FIG. 3 is an exploded view of the preferred form of crimping tool shown in FIGS. 1 and 2.
Figure 4:
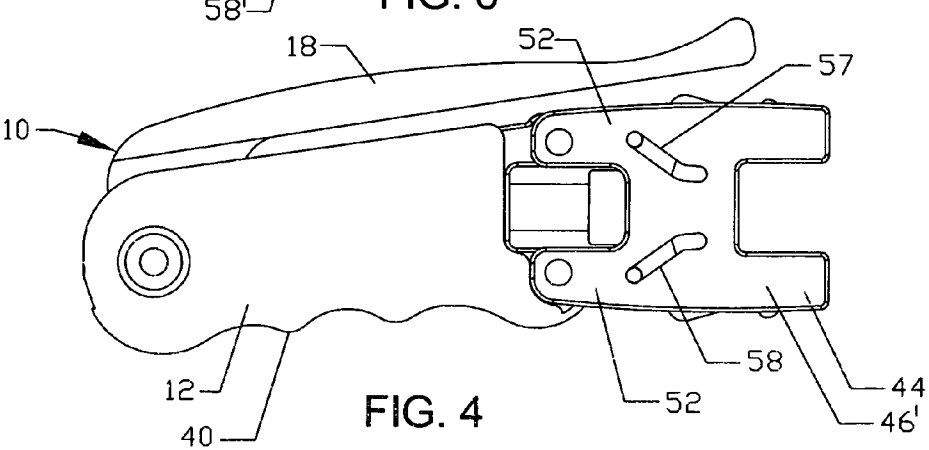
FIG. 4 is a side view of the preferred form of crimping tool.
Figure 5:
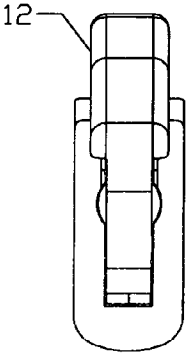
FIG. 5 is an end view of the main body of the preferred form of crimping tool.

Referring in more detail to the drawings, one embodiment of hand-held tool 10 is shown in Figures 1A through 6 and is broadly comprised of an elongated body 12 of generally channel-shaped configuration, as best seen from FIGS. 3 and 5. A plunger assembly 15 extends through a plunger-receiving bore 16 in the body, and a lever arm 18 has an offset end portion 19 pivotally mounted in a channel at the rear end of the body 12. A floating link 22 is pivotally attached at 23 in offset relation to the pivot 20 and pivotally attached at its opposite end 24 to an end of a plunger 14. Further, the lever arm 18 is of a width substantially corresponding to the width of the channel in the body 12 so as to be free to pivot from the extreme raised or upright position shown in FIG. 1 to the substantially horizontal position overlying the body 12, as shown in FIG. 4. The plunger assembly 15 comprises a plunger 14 which is slidable through bushing 28 in the bore 16 and terminates in a large hollow housing 30 for a spring stack 32. A sleeve 34 surrounds the leading end of the bushing 28, and the spring stack 32 bears against the end of the sleeve 34 when the lever handle 18 is advanced into the lowered or closed position as shown in FIG. 2.

The chuck 36 is secured to the end of the plunger 14 so as to mount the spring stack 32 under compression between the sleeve 34 and spring housing 30 and corresponds to the lengthwise compliant chuck of my U.S. Pat. No. 6,293,004 which is incorporated by reference herein. The trailing end of the body 12 terminates in upper and lower bosses 38, and the underside of the body is provided with grooves or depressions 40 to facilitate gripping of the tool 10.

As shown in FIGS. 2 and 3, a die support 44 defines an axial extension of the body 12 and is made up of generally rectangular guideways 46 and 46' in laterally spaced relation to one another and interconnected by upper and lower spaced braces 47 and 48 on rearward extension arms 45 of the guideways 46 and 46', each brace including a connecting pin 50 at its free end which is adapted to be inserted in snug-fitting relation to an aligned socket on the upper and lower arms 45 of the opposite guideway 46 or 46'. Leading arm members 52 on each of the guideways 46 and 46' are spaced apart such that they can receive the bosses 38 therebetween and have openings 54 which are aligned with the bosses 38 to receive a suitable fastener 56 to rigidly interconnect the die support to the end of the body 12.

A pair of upper and lower inclined slots 57 and 58 are formed in each of the guideways 46 and 46', the slots diverging away from one another in a direction toward the body 12, and the inner adjacent ends of the slots 57 and 58 each terminate in a slight dog leg or axially extending slotted portion 57', 58'. A pair of upper and lower complementary members or die halves 61 and 62 are correspondingly formed and each includes a semi-circular die cavity 64 in a die block 66 which extends at right angles to a thin flat arm portion 68, the latter terminating in a right angle flange 70 having a transversely extending pin 72. The pins 72 are adapted to fit into opposed upper and lower slots 49 extending axially between each brace 47, 48 and outer edge of each guideway. Each of the pins 72 is spring loaded or biased by a compression spring member 74 extending forwardly along each of the slots 49 toward the main body 12 so as to yielding urge the die members 61 and 62 in a rearward direction causing the pins 63 to be normally positioned in the slotted portion 57', 58' , as best seen from FIGS. 2 and 2A.

Forward advancement of the die members 61, 62, for example, by manually forcing the ends 70 along the slots 49 against the urging of the spring members 74 will cause the pins 63 to slide in outward, substantially diagonal directions through the slots 57 and 58 into the expanded position shown in FIGS. 1 and 1A. When the ends 70 are released, the spring members 74 will force the pins 63 to return in a rearward direction through the inclined slots 57 and 58 into the inner contracted position shown in FIG. 2.

The configuration of the die cavities 64 is dictated largely by the configuration of the connector sleeve of the fitting F as shown in FIGS. 1, 1A, 2 and 2A, the fitting F being loosely assembled onto a conventional coaxial cable C. The cable C is made up of an inner conductor R surrounded by a dielectric insulator S, an outer braided conductor T and an external jacket U. The cable end is prepared by removing a portion of the outer jacket U, braided conductor T and insulator S so as to expose an end of the conductor R. A portion of the braided conductor T is folded over a forward end of the jacket U for insertion into the fitting F in a manner to be described.

The fitting F is representative of various different types of compression connectors which can be utilized with the crimping tool of the present invention, and the fitting is comprised of inner and outer spaced concentric sleeves 74 and 76, the inner sleeve 74 terminating in a shoulder 77 which bears against a shoulder on ferrule or threaded end 78 which is adapted to be connected to a terminal, such as, a TV terminal. The outer concentric sleeve 76 terminates in an external shoulder 80 which bears against the opposite end of the ferrule 78 to the shoulder 77 on the inner sleeve 75.

Figure 2B:
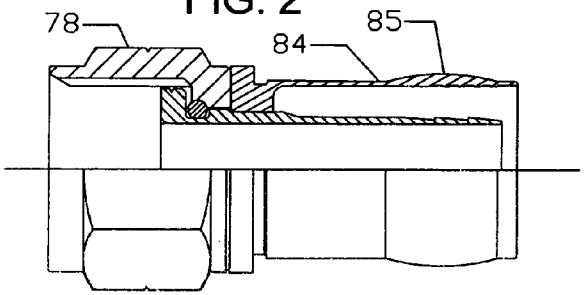
FIG. 2B is a sectional view of a preferred form of fitting prior to the crimping operation.

A novel feature of the fitting F is the shape of the outer connector sleeve 76 which has a thin-walled portion 82 of substantially uniform diameter and a thickened portion 84 at its trailing end having an outer raised or convex surface 85 opposite to an inner surface having alternatIng endless ribs 86 and grooves 87, as shown in FIG. 2B, the ribs 86 customarily referred to as sealing rings. As shown in FIG. 1A, the die cavities 64 are correspondingly formed with a conical surface 88 which flares outwardly toward the leading end of its die block 66 facing the body 12, a second more sharply inclined surface 89, a third oppositely inclined surface 90, a fourth generally convex surface 91 which corresponds to the configuration of the convex surface portion 85 of the connector sleeve 76 and a fifth generally conical surface diverging rearwardly away from the body 12 and terminating in a grooved surface portion 93. Overall, the cavity is dimensioned to slope in an inward radial direction from the leading end 88 to a diameter slightly less than the outer diameter of the convex section 85 and then undergo a further reduction in diameter 91 to a diameter substantially corresponding to the external diameter of the sleeve section 82. In this way, when the die halves are in their inner contracted position as shown in FIG. 2 and the plunger 14 is advanced by pivoting the handle 18 downwardly, the chuck 36 will force the fitting F rearwardly to move the thickened portion 84 of the sleeve 76 initially into engagement with the conical portions 88, 89 of the die cavities; the portion 84 will advance thereafter into engagement with the convex portion 91 of the cavity thereby causing the thickened portion 84 and adjacent portion 82 of the connector sleeve to be compressed radially into crimping, sealed engagement with the cable end C and such that the ribs 86 in the inner wall surface will assume a generally convex cross-sectional configuration as shown in FIG. 2C. Accordingly, the maximum amount or degree of crimping will occur along the thickened portion 84 rearwardly of the guide pins 63 thereby exerting a progressively increased closing force forwardly of the guide pins 63 and keep the die members closed during the forming operation notwithstanding slight variations in manufacturing tolerance or wear during use. In this relation, the location of the guide pins 63 assures that the dies will be properly held in position during the crimping operation, since the center line of the guide pin 63 is centered on the recess that generates the crimping operation, and the arm members 68 will control the attitude of the die members as they slide rearwardly through the slots 57, 58 and 49. Specifically, these features overcome the wear and misalignment problems inherent in the utilization of die halves that open and close about a fixed pivot.

In practice, the die members 61 and 62 are manually pressed forwardly into their expanded positions as illustrated in FIG. 1A, and the cable end C is inserted into the fitting F with the outer braided portion T which is doubled over the jacket U being inserted into the annular space between the inner and outer concentric sleeves 75 and 76. In other words, the pins 63 will slide freely through the slots 57 and 58 when the plunger 14 is retracted by lifting of the handle 18 and manual pressure is applied to advance the arms 68 in a forward direction against the urging of the springs 74. In the alternative, assuming that the die members or halves are in their normal contracted position in flush contacting relation to one another, when the fitting F and cable end C are inserted forwardly through the die support the fitting F will force the die halves 61 and 62 to slide forwardly and outwardly along their respective guideways 46 and 46' to the position illustrated in FIG. 1A. Once the fitting F clears the die halves 61 and 62, the die halves will return to their inner contracted position, as shown in FIG. 2, under the urging of the compression spring members 74. As previously described, the handle 18 can be pivoted to force the sleeve members 74 and 76 rearwardly through the die halves 61 and 62 until the threaded end 78 and shoulder 80 abut entrance 88 to the cavity at which point the crimping operation is completed as shown in FIG. 2A. In this relation, the slotted portions 49 are angled on the order of 5° to 7° to the longitudinal axis of the die support 44 so as to minimize any tendency to jam at the completion of the crimping stroke.

As the chuck applies continued pressure in forcing the fitting F rearwardly through the die members 61 and 62, the pins 63 will absorb some of the thrust in advancing along the inner slotted portions 49 but the major part of the thrust will be absorbed by the spring-loaded chuck member 36. Once the crimping operation is completed, the die members 61 and 62 can be advanced forwardly by manually sliding the arm portions 68 against the urging of the spring members 74 to return the die members to the expanded position as shown in FIGS. 1 and 1A and permit the crimped fitting F and cable C to be removed.

DETAILED DESCRIPTION OF SECOND EMBODIMENT

Figure 6:
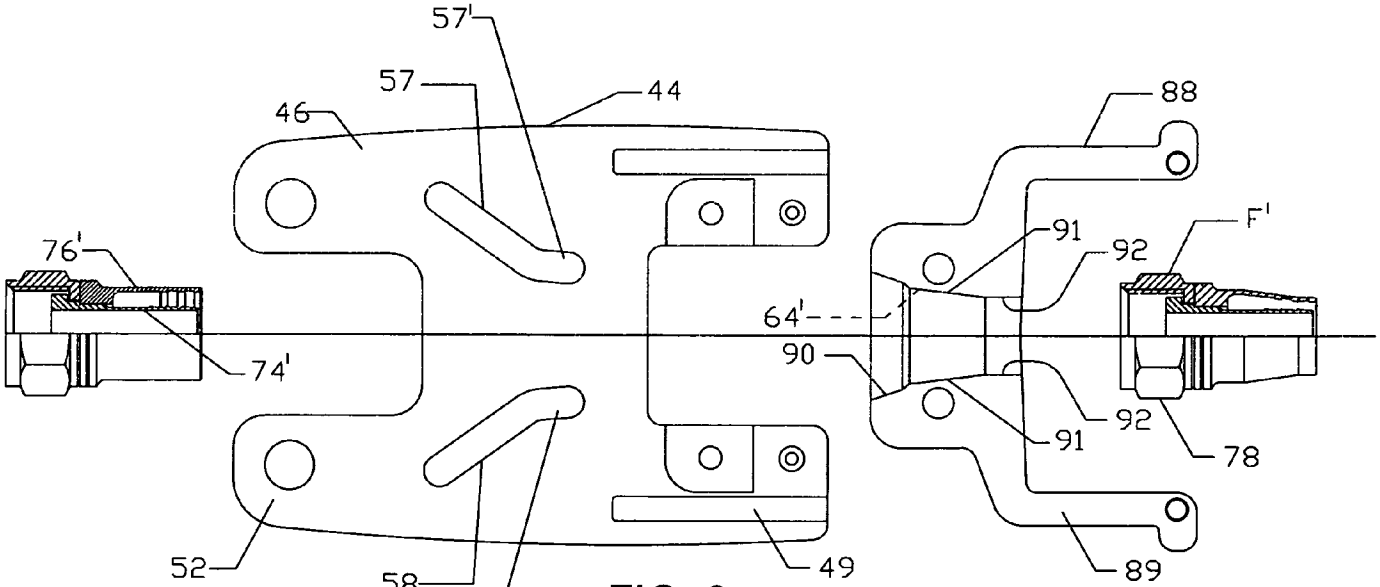
FIG. 6 is a detailed view of another preferred form of die and die support.

FIG. 6 illustrates another form of invention in which like parts to those of FIGS. 1 to 5 are correspondingly enumerated. Thus, the die support 44 corresponds to that of FIGS. 1 to 5 but the die halves 88 and 89 are provided with more of a straight conical cavity 64' consisting of a first wide angle conical portion 90 converging into an intermediate, relatively low angle conical portion 91 and a third portion 92 of relatively uniform diameter. This is designed more for use with a fitting F' having inner and outer concentric connector sleeves 74' and 76' in which outer sleeve 76' is of uniform or substantially uniform thickness.

The die cavities 64' are dimensioned such that when the fitting is forced rearwardly by the plunger the outer connector sleeve 76' will initially contact the conical portion 91 and undergo inward radial contraction as it advances through the conical portion 91 until the crimping operation is completed and force the outer connector sleeve into a conical cross-section firmly engaging the outer exposed portion of the cable end C.

DETAILED DESCRIPTION OF ALTERNATE EMBODIMENTS

Referring to FIGS. 7, 7A, 8, 8A, 8B and 8C, a tool 10' is illustrated in which like elements to the tool 10 of FIGS. 1, 1A, 2, 2A, 2B and 2C are correspondingly enumerated. The fitting L of FIGS. 7, 7A, 8, 8A, 8B and 8C contains the same basic elements and size as the fitting F shown in FIGS. 1,1A, 2,2A, 2B and 2C, as best seen from a comparison of FIGS. 2B and 2C which are the same scale as FIGS. 8B and 8C. In order to compensate for the increased length of the guideways 46 and 46' as hereinafter described to accommodate longer fittings, such as, illustrated in FIGS. 10 and 10A, a tip extender 41 is inserted into a receiver 37 at the end of the chuck 36, the tip 41 being of the type shown in U.S. Pat. No. 7,096,573 which is incorporated by reference herein. The tip extender 41 is made up of a cylindrical body inserted in the receiver 37 at the end of the chuck 36 having circumferentially spaced spring clips 39. The receiver 37 includes a grooved or channel-shaped end 42 of reduced diameter in relation to the base 42' of the tip 41, and an axially extending, central bore 43 extends through the receiver 37. The bore 43 is adapted to receive the inner conductor pin R of the cable C when the ferrule 78 on the fitting L is mounted on the tip extender 41.

As best seen from FIGS. 11 to 14, the guideways 46 and 46', in comparison to the correspondingly numbered guideways in FIGS. 1 to 6, are increased in length to accommodate variations in length of different fittings; and the guideways 46 and 46' of FIGS. 11 to 14 are increased in width across their midsections through the slots 57 and 58 so as to be of generally oval-shaped configuration and to terminate in forwardly convergent, bifurcated end portions 52 to receive the leading ends 38 of the tool body 12. In this way, an enlarged, generally diamond-shaped recess 59 can be formed between the bifurcated ends 52 and rearwardly convergent side edges 53 in spaced parallel relation to the slots 57 and 58. As best seen in FIGS. 8, 8A, 9 and 10, the enlarged recess 59 as formed enables access by the user for manual insertion and removal of the extender tip 41 without sacrificing any strength in the frame itself. At the same time, the convergent, bifurcated ends 52 terminate in the same spaced relationship as illustrated in FIGS. 1 to 6 for connection to the bosses 38 on the trailing end of the body 12. Any variations in diameter or size of the fitting L are compensated for by bending or curving the leading end of each slot 49 to form angled or inclined end slots 49' on the order of 20° to 30° which diverge away from one another. In addition, the slots 49 and 49' may be increased in width to accommodate larger diameter pins 72 at the trailing end of each arm 68. As in the form of FIGS. 1 to 5, each of the pins 72 is spring-loaded by a compression spring member 74 away from the chuck 46 to yieldingly urge the die members 61 and 62 in a rearward direction.

Figure 7A:
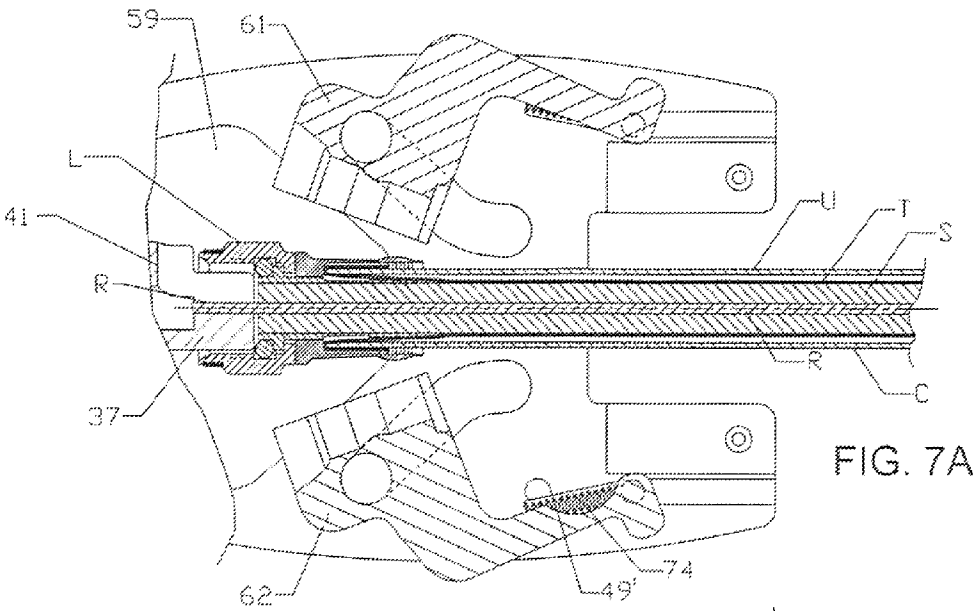
FIG. 7A is a fragmentary section view in detail of a portion of the tool shown in FIG. 7 with the die portions in their spread position.
Figure 7:
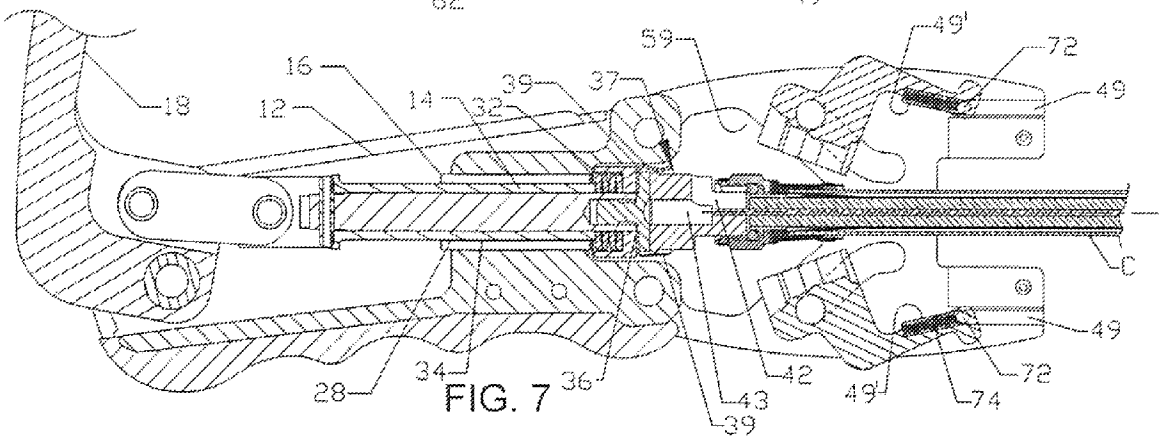
FIG. 7 is a longitudinal section view of a modified form of compression tool for larger size fittings than in FIG. 1.
Figure 8A:
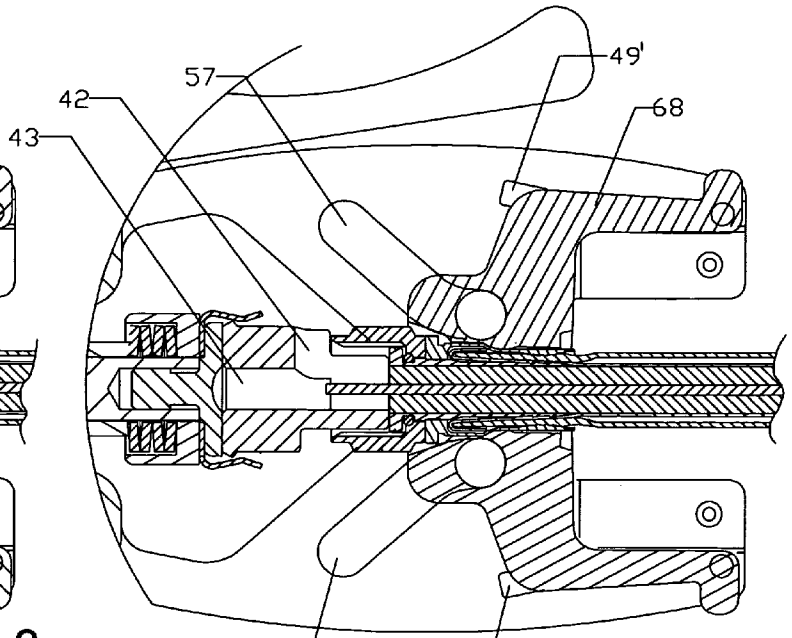
FIG. 8A is a fragmentary view in section of the die portions in their contracted state after the crimping operation.
Figure 8C:
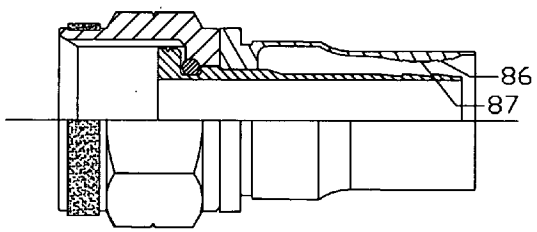
FIG. 8C is a sectional view of the fitting shown in FIG. 8B after the crimping operation.
Figure 8:
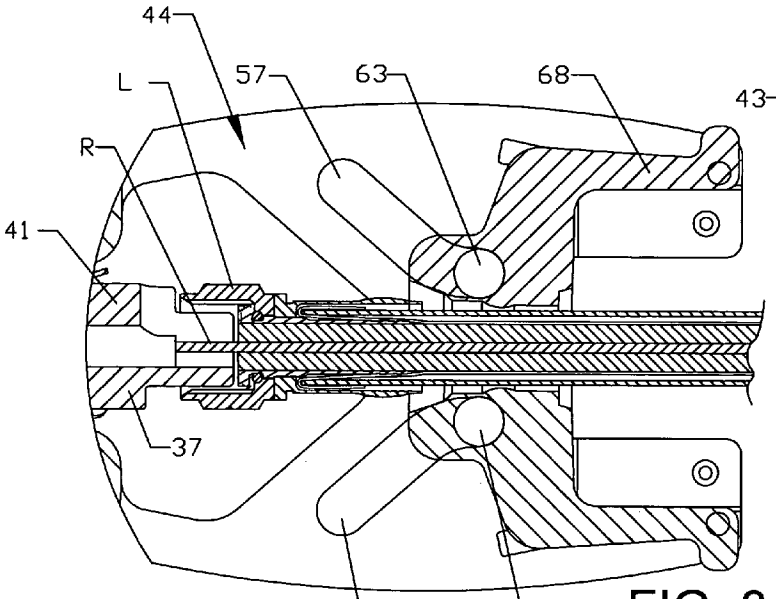
FIG. 8 is a fragmentary view in section of the die portions of FIGS. 7 and 7A in their contracted position prior to crimping.
Figure 8B:
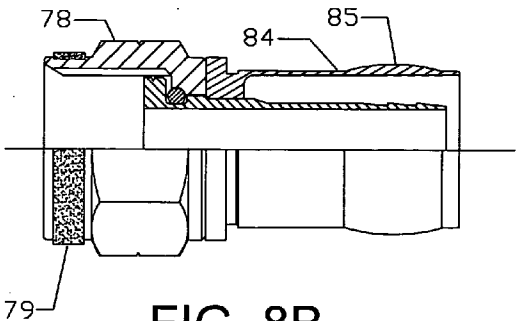
FIG. 8B is a sectional view of the fitting illustrated in FIGS. 8A and 8B.
Figure 9:
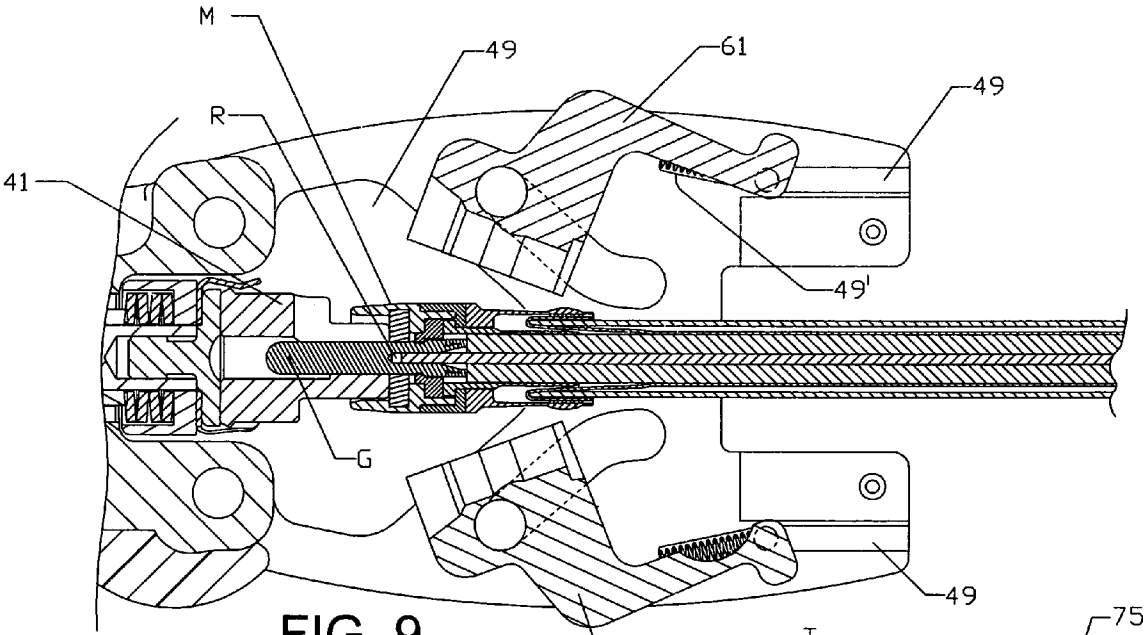
FIG. 9 is a longitudinal section view of still another form of compression tool adapted for use with larger size fittings provided with an extension tip on the of the cable.
Figure 9B:
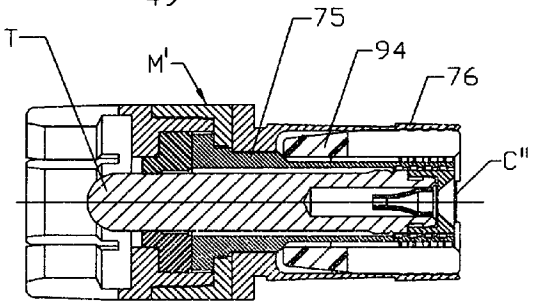
FIG. 9B is a sectional view of the end of another form of fitting utilized with mini-coaxial cable connectors.
Figure 9A:
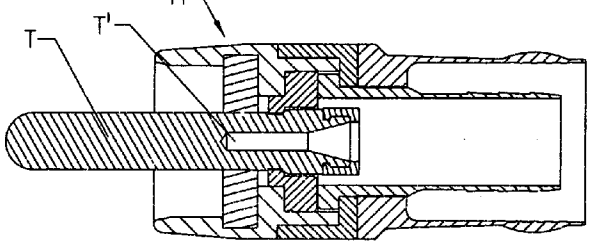
FIG. 9A is a sectional view in more detail of the fitting illustrated in FIG. 9.

FIGS. 9 to 14 illustrate the same tool 10' as shown in FIGS. 7 to 8C for crimping an RCA connector or fitting M of the type having an extender or starter guide G with a socket G' for insertion of the inner pin conductor R of the cable C, the starter guide G being shown in more detail in U.S. Pat. No. 6,352,448 entitled CABLE TV END CONNECTOR STARTER GUIDE incorporated by reference herein. Thus, the tip extender 41 is sized to receive the starter guide G in the bore 43 and in the leading end of the fitting M. In this way, the fitting is securely supported and the tip 41 is anchored in centered relation to the dies 61,62 as the dies 61,62 are advanced into crimping engagement with the fitting M. A fitting M' is illustrated in FIG. 9B and is of the same outside diameter as the fitting M of FIG. 9A but includes an annular plastic insert 94 in the space between the inner and outer concentric sleeves 75 and 76 for a mini-coaxial cable represented at C, and the outer jacket U and braided insulator T are wedged between the plastic insert 94 and the inner sleeve 75. The fitting of FIGS. 8B and 8C is modified with respect to that of FIGS. 2B and 2C by mounting an elastic color band 79 in a groove at the reduced end portion of the ferrule 78 and which end is adapted for placement onto a terminal on a TV, audio receiver and the like in a well-known manner. For this purpose, the color band is dyed or colored to signify the intended application of the fitting to a particular use. The advantage of the placement of the color band 79 on the leading end of the ferrule 78 is that it can be mounted in the field either before or after the fitting is crimped onto the end of the cable C. In addition, in FIG. 9B the starter guide G is shown in a retracted position within the fitting instead of the extended position as shown in FIG. 9A.

Figure 10:
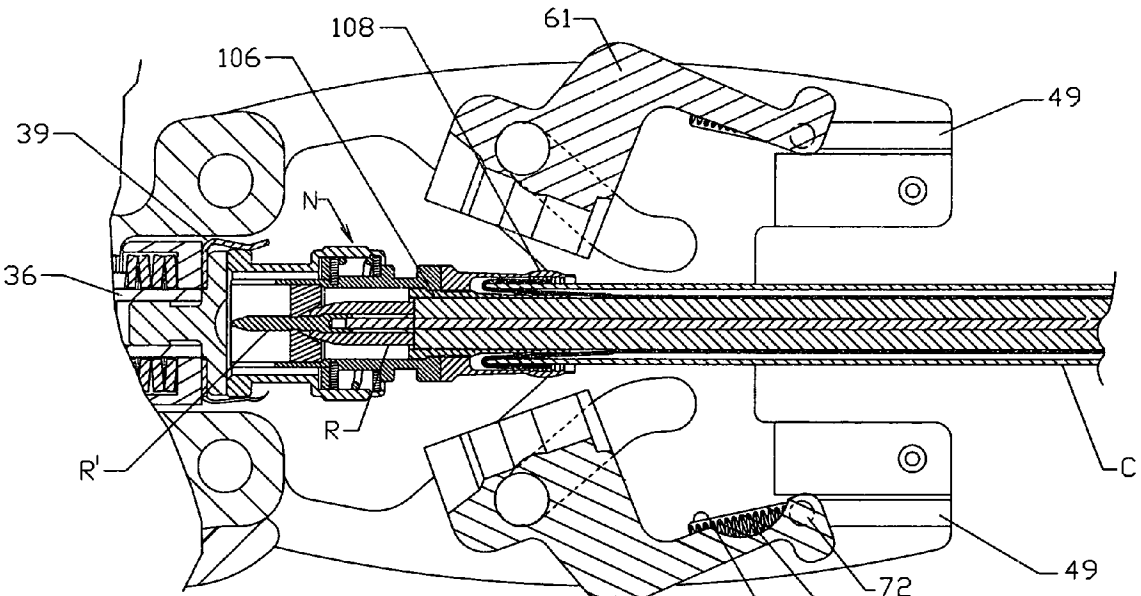
FIG. 10 is a fragmentary sectional view of the tool shown in FIGS. 7 and 7A dimensioned for use with larger diameter fittings than those illustrated in FIGS. 7 to 9.
Figure 10A:
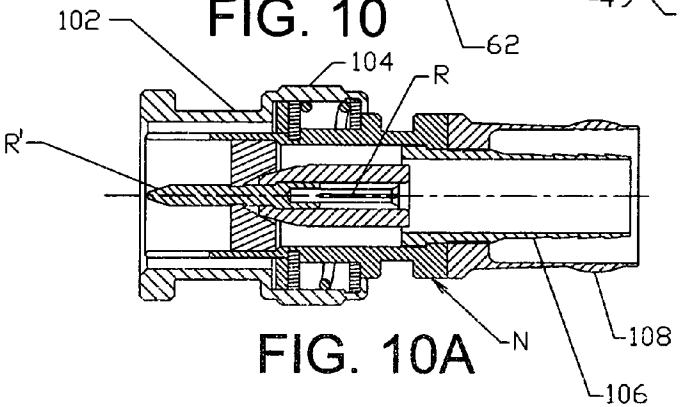
FIG. 10A is a detailed sectional view of the fitting illustrated in FIG. 10.

In FIGS. 10 and 10A, another form of coaxial cable connector is shown, namely, a BNC connector N of increased length compared to the fittings L and M and specifically is of the type having an elongated barrel 102 with a bayonet slot connection to a ferrule 104 and inner and outer spaced connector sleeves 106 and 108. A cable C is connected within the end of the fitting N with an extension R' of the conductor pin R terminating substantially flush with the leading end of the barrel. Owing to the increased length of the fitting N, the tip 41 cannot be used and accordingly the fitting is secured directly to the end of the chuck 36 by the spring clips 39 in the same manner as the end of the tip 41 is engaged by the spring clips 39 in the form shown in FIGS. 8 to 8C.

FIGS. 11 to 14 illustrate the parts comprising the compression tool, and further illustrates a fitting F' at opposite ends of the tool parts prior to and after crimping. In particular, FIGS.

13 and 14 illustrate one of the guideways 46 which corresponds to the guideway 46 of FIG. 6 but again is wider and longer as previously described. In addition, the slots 49 including the divergent extensions 49' are slightly longer than the slots 49 of FIGS. 1 to 6 so as to permit the upper and lower spaced braces 47 and 48 on the rearward extension arms 49 to undergo increased travel and resultingly increased expansion of the dies 66 to accommodate larger diameter fittings.

In a manner similar to FIGS. 1 to 6, the pins 72 which are adapted to fit into the slots 49 can be manually forced along the slots 49 against the urging of the spring members 74 so as to cause the pins 63 to advance in outward diagonal directions through the slots 57 and 58 into an expanded position as illustrated in FIGS. 7 and 7A to enable insertion of the fitting into engagement with the chuck. When the ends 70 are released, the springs 74 cause the pins 72 to return through the slots 49' and 49, and the pins 63 to return through the slots 57 and 58 until they reach the inner contracted position, for example, as illustrated in FIGS. 8 and 8A. Again, an important distinction in the modified embodiments illustrated in FIGS. 7 to 14 is the ability of the die halves to be spread wider apart to accommodate different sizes of fittings and yet can be returned into a contracted position as shown in FIG. 8 preliminary to an axial forward advancement of the fitting F or M under the urging of the plunger 14 when the handle 18 is pivoted inwardly toward the body 10.

Figure 13:
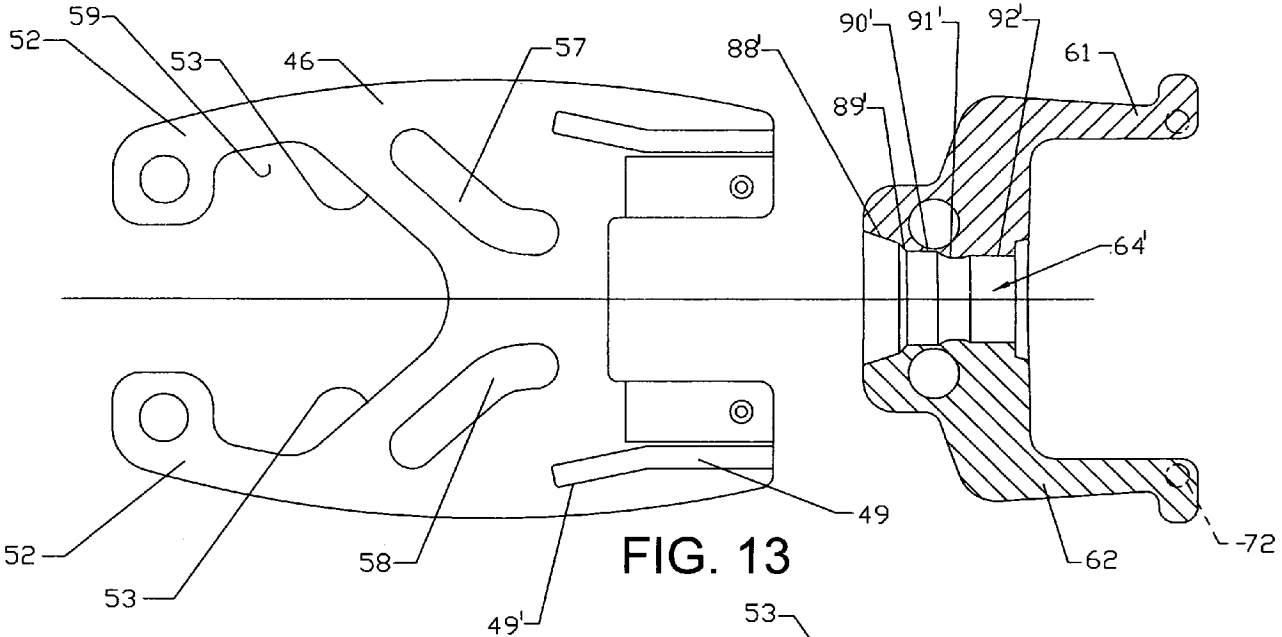
FIG. 13 is an exploded view of one side of the tool shown in FIGS. 10 to 12 and sectional views of the form of fitting illustrated in FIG. 6 prior to and after the crimping operation.
Figure 11:
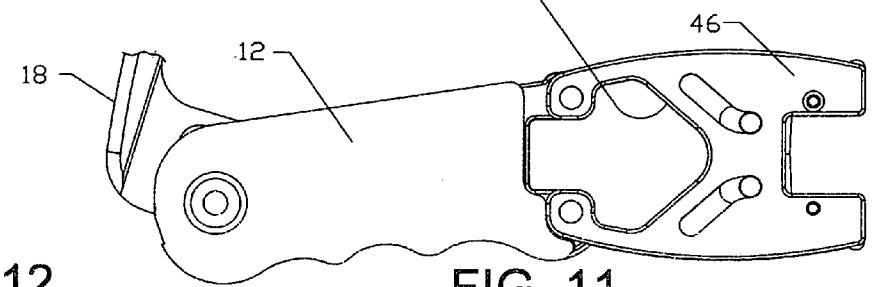
FIG. 11 is a side view in elevation of the body of the tool shown in FIG. 10.
Figure 12:
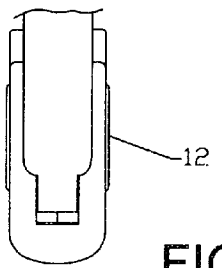
FIG. 12 is an end view of the body of the crimping tool shown in FIG. 11.
Figure 14:
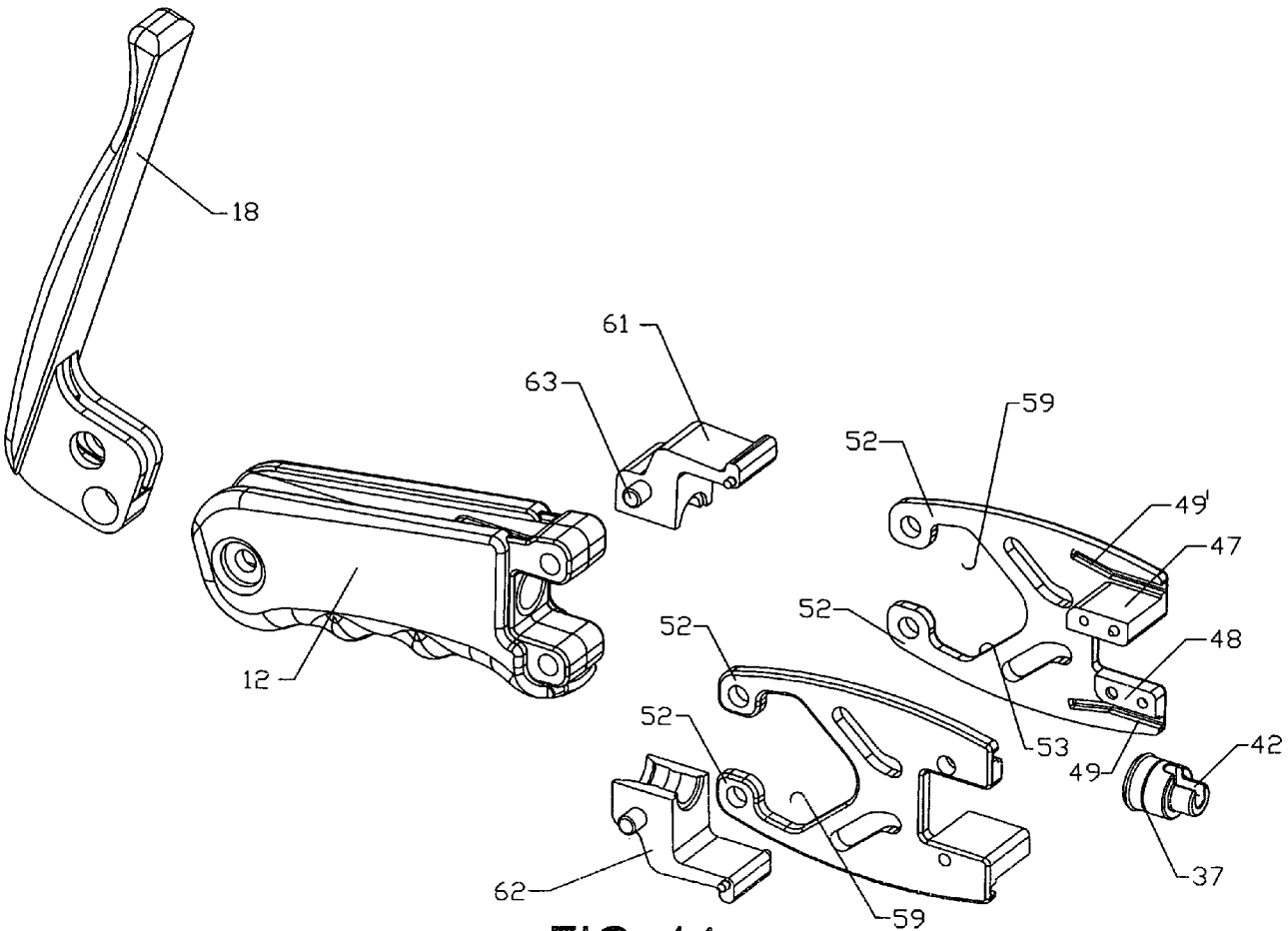
FIG. 14 is an exploded perspective view of the parts of the tool illustrated in FIGS. 7 to 13.

Referring for example to FIGS. 8, 8A and 13, the die cavities are each correspondingly formed with a tapered surface 88' which flares outwardly toward the leading end of the die block 66, a second more sharply tapered surface 89', a third cylindrical surface 90', a fourth generally convex surface 91' and a fifth generally cylindrical surface 92' of a diameter corresponding to that of the cylindrical surface 90'. The cavities 64' are dimensioned such that the surfaces 88' and 89' afford ample clearance for rearward advancement of the fitting F or M initially for engagement with the thickened or raised portion 84 on the fitting F or M to compress radially into engagement with the cable end C. This is followed by increased crimping by the convex surface portions 91' until the thickened portions 85 are flattened so as to be flush with the external surface of the outer sleeve 76, and the ribs 86 in the inner wall surface of the sleeve 76 will assume a generally convex cross-sectional configuration as shown in FIG. 8C with the ribs 86 moving into sealed engagement with the cable end C. It will be evident that the precise dimensioning of the die surfaces 88' to 92' may be varied in accordance with the degree or extent of crimping required and particularly along the surfaces 90' and 91'. The specific angles or curvatures given to the surfaces 88', 89' and 92' may vary appreciably, since their primary function is to afford sufficient clearance for advancement of the fitting into crimping engagement with surfaces 90' and 91' and sufficient clearance for removal or opening of the die halves away from the fitting at the end of each crimping operation.

It is therefore to be understood that while different embodiments are herein set forth and described, the above and other modifications may be made therein without departing from the spirit and scope of the invention as defined by the appended claims and reasonable equivalents thereof.

We claim:

1. A compression tool adapted to connect a sleeve portion of a cable fitting to an end of a cable wherein said tool is provided with a body and guideways at one end of said body, a plunger, and means for axially advancing said plunger toward and away from said guideways, the improvement comprising:

an extension tip releasably connected to one end of said plunger; and a plurality of die members having forward and rearward ends, the plurality of die members mounted between said guideways for slidable movement between a radially expanded position in which said cable fitting is movable into contact with said extension tip and a contracted position in which said die members are slidable into a radially contracted position, wherein positive advancement of said sleeve portion and said die members into engagement with one another causes said sleeve portion to be contracted into crimping engagement with said cable end;

wherein said guideways include means for spreading said forward ends of said die members into the expanded position and contracting said forward ends of said die members into the contracted position, wherein on each of said guideways said means for spreading said forward ends includes forward inclined guide portions;

wherein said guideways further include means for spreading said rearward ends of said die members into the expanded position and contracting said rearward ends of said die members into the contracted position; and wherein said guideways are provided with generally diamond-shaped recesses at one end, said recesses having convergent edges extending rearwardly in spaced, substantially parallel relation to said forward inclined guide portions.

2. A compression tool according to claim 1 wherein said guideways are connected to said body on each side of said extension tip, and said plunger includes a chuck interconnecting said extension tip and end of said plunger.

3. A compression tool according to claim 1 wherein on each of said guideways said means for spreading said rearward ends includes rearward inclined guide portions.

4. A compression tool according to claim 3 wherein said guide portions are slots.

5. A compression tool according to claim 3 wherein said die members have front and rear pins on opposite sides thereof movable through said forward and rearward inclined guide portions.

6. A compression tool according to claim 5 further comprising springs associated with said die members to urge said die members rearwardly toward the contracted position.

7. A compression tool according to claim 6 wherein said die members define semi-circumferential portions of a cavity, at least one of said die members being movable into and out of circumferential alignment with the other of said die members.

8. A compression tool according to claim 7, wherein said cavity has an axially extending convex configuration movable into engagement with said sleeve in response to said relative axial movement between said sleeve members and said die members thereby contracting said outer sleeve member into crimping engagement with said portion of cable end.

9. A compression tool according to claim 8 wherein said relative axial advancement between said sleeve members and said cavity causes a thickened portion of the sleeve to be compressed into crimping engagement with said cable end.

10. A compression tool adapted to connect a sleeve portion of a cable fitting to an end of a cable, comprising:

a body having a bore extending axially therethrough;

a plunger received in the bore and having a first end in facing relation to the end of the cable, the first end configured to releasably connect to an extension tip;

a first guideway and a second guideway, the first and second guideways being supported by the body and each defining a forward slot and a rearward slot spaced axially apart from the forward slot, each of the forward slots having a first portion inclined relative to an axis of the bore, and each of the rearward slots having a first portion inclined relative to the axis of the bore; and a first die member and a second die member, the first and second die members slidably coupled to the guideways and moveable between a radially expanded position in which the cable fitting is movable into contact with the extension tip and a contracted position in which the die members are radially contracted;

wherein positive advancement of the fitting and the die members into engagement with one another by the plunger causes the fitting to be contracted into crimping engagement with the cable end;

wherein the first die member includes a forward pin and a rearward pin spaced axially apart from the forward pin, the forward pin being received in the forward slot and the rearward pin being received in the rearward slot; and wherein when the first die member moves to the radially expanded position, motion of the rearward pin along the inclined portion of the rearward slot has a radial component.

11. The compression tool of claim 10 further comprising a means for axially advancing the plunger toward and away from the guideways.

12. The compression tool of claim 10, wherein each die member includes a forward pin and a rearward pin spaced axially apart from the forward pin, the forward pins being received in the forward slots and the rearward pins being received in the rearward slots; and wherein when the die members move to the radially expanded position, the rearward pins move apart from one another along the inclined portions of the rearward slots.

13. The compression tool of claim 10, wherein the die members define semi-circumferential portions of a cavity, at least one of the die members being movable into and out of circumferential alignment with the other of the die members.

14. A compression tool according to claim 10 wherein the die members at least partially define a cavity, and wherein the die members are slidable radially and axially into the contracted position in response to axial advancement of the plunger forcing the fitting at least partially through the cavity.

15. A compression tool according to claim 14 wherein each of the die members has pins slidable through the guideways in opposite sides of the bore to advance the die members between the expanded position and the contracted position.

16. A compression tool according to claim 15, wherein each of the die members includes a pair of the pins on opposite sides of the die members, the pair of pins being slidable through the forward slots on the first guideway and the second guideway on the opposite sides of the bore.

17. A compression tool according to claim 15, wherein each of the die members includes a pair of the pins on opposite sides of the die members, the pair of pins being slidable through the rearward slots on the first guideway and the second guideway on the opposite sides of the bore.

18. A compression tool according to claim 10, wherein each of the first guideway and the second guideway are provided with a generally diamond-shaped recess at one end, the recess having convergent edges extending rearwardly in spaced, substantially parallel relation to the first portion of the forward slot.

19. A compression tool adapted to connect a sleeve portion of a cable fitting to an end of a cable, comprising:

a body having a bore extending axially therethrough;

a plunger received in the bore and having a first end in facing relation to the end of the cable, the first end configured to releasably connect to an extension tip;

a first guideway and a second guideway, the first and second guideways being supported by the body and each defining a forward slot and a rearward slot spaced axially apart from the forward slot, each of the forward slots having a first portion inclined relative to an axis of the bore, and each of the rearward slots having a first portion inclined relative to the axis of the bore; and a first die member and a second die member, the first and second die members slidably coupled to the guideways and moveable between a radially expanded position in which the cable fitting is movable into contact with the extension tip and a contracted position in which the die members are radially contracted;

wherein positive advancement of the fitting and the die members into engagement with one another by the plunger causes the fitting to be contracted into crimping engagement with the cable end;

wherein each die member includes a forward pin and a rearward pin spaced axially apart from the forward pin, the forward pins being received in the forward slots and the rearward pins being received in the rearward slots; and wherein when the die members move to the radially expanded position, the rearward pins move apart from one another along the inclined portions of the rearward slots.

20. A compression tool according to claim 19, wherein each of the first guideway and the second guideway are provided with a generally diamond-shaped recess at one end, the recess having convergent edges extending rearwardly in spaced, substantially parallel relation to the first portion of the forward slot.

* * * * *